US006945621B2

(12) United States Patent
Shin

(10) Patent No.: US 6,945,621 B2
(45) Date of Patent: Sep. 20, 2005

(54) REFRIGERATOR ASSEMBLY UNIT

(75) Inventor: Dong-In Shin, Kwangju (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/244,536

(22) Filed: Sep. 17, 2002

(65) Prior Publication Data

US 2003/0132689 A1 Jul. 17, 2003

(30) Foreign Application Priority Data

Jan. 15, 2002 (KR) ..... 2002-2340

(51) Int. Cl.[7] ..... A47B 96/06; E05D 11/06

(52) U.S. Cl. ..... 312/405; 16/359

(58) Field of Search ..... 312/401, 405, 312/326, 329, 116, 138.1; 16/221, 382, 357, 358, 359, 375, 361

(56) References Cited

U.S. PATENT DOCUMENTS

| | | | | |
|---|---|---|---|---|
| 2,867,839 A | | 1/1959 | Squire | |
| 3,065,498 A | * | 11/1962 | Johnson | 16/359 |
| 3,083,403 A | * | 4/1963 | Van Noord | 16/361 |
| 4,609,234 A | * | 9/1986 | Naniwa et al. | 312/296 |
| 5,265,954 A | * | 11/1993 | Keil | 312/405 |
| 5,272,789 A | | 12/1993 | Mitchell et al. | 16/291 |
| 5,884,366 A | * | 3/1999 | Jeong | 16/271 |
| 5,931,554 A | | 8/1999 | Koopman | 312/405 |
| 6,128,807 A | | 10/2000 | Lim et al. | 16/266 |

FOREIGN PATENT DOCUMENTS

| | | |
|---|---|---|
| CH | 687 576 | 1/1997 |
| EP | 703 336 | 3/1996 |
| FR | 2 348 633 | 11/1977 |
| FR | 2 673 971 | 9/1992 |
| JP | 2-285184 | 11/1990 |
| JP | 3-105682 | 11/1991 |
| JP | 4-44583 | 2/1992 |
| JP | 11-83294 | 3/1999 |
| JP | 2000-46459 | 2/2000 |
| KR | 1992-1879 | 4/1990 |
| KR | 1992-6318 | 5/1992 |
| KR | 1997-7231 | 2/1997 |
| KR | 142057 | 3/1998 |

OTHER PUBLICATIONS

Copy of SIPO Office Action for Patent Application No. 02130558.7 (related to present application)—no date given, 3 pages.

* cited by examiner

*Primary Examiner*—James O. Hansen
(74) *Attorney, Agent, or Firm*—Staas & Halsey LLP

(57) ABSTRACT

A refrigerator having a cabinet forming a refrigerator compartment; a door opening and closing the refrigerator compartment; and a hinge member rotatably connecting the door to the cabinet. The hinge member has a rotation axis varying in position, depending on rotation angles of the door between a full open position at which the refrigerator compartment is fully opened and a closed position at which the refrigerator compartment is closed.

7 Claims, 8 Drawing Sheets

REFRIGERATOR ASSEMBLY UNIT

CROSS-REFERENCE TO RELATED APPLICATIONS

This application claims the benefit of Korean Application No. 2002-2340, filed Jan. 15, 2002, in the Korean Industrial Property Office, the disclosure of which is incorporated herein by reference.

BACKGROUND OF THE INVENTION

1. Field of the Invention

The present invention relates in general to a refrigerator, and more particularly, to a refrigerator assembly unit improving a rotation of a door against a cabinet.

2. Description of the Related Art

A refrigerator normally has a cabinet forming a refrigerator compartment, and a door provided in front of the refrigerator compartment to open and close the refrigerator compartment. The cabinet and the door are connected by a hinge member.

The hinge member includes a hinge bracket having a first end connected to the cabinet, and a second end connected to the door and provided with a hinge hole, and a hinge pin connected with the door through the hinge hole. Thus, the door rotates against the cabinet on an axis of the hinge pin.

To allow a user to put food into the refrigerator compartment or remove food therefrom, the door is generally rotated over a right angle to open the refrigerator compartment. Herein, the location of the hinge pin is significant as follows.

FIG. 7 illustrates a rotation of a door when a hinge pin is positioned at a rear corner of the door, namely, adjacent to a cabinet. As illustrated therein, a door 120 opens and closes a refrigerator compartment 110*a*, being rotated on the axis of a hinge pin 135.

However, in the case that the hinge pin 135 is positioned as illustrated in FIG. 7, when the door 120 is fully rotated, a corner part of the door 120 positioned in front of the hinge pin 135 protrudes over the outer wall of the cabinet 110, thereby creating an interference part "$I_1$". Thus, the refrigerator is required to be disposed at a position spaced apart from a wall, a sink, etc., to avoid the interference part "$I_1$".

Contrary to the hinge pin 135 of FIG. 7, FIG. 8 illustrates the rotation of the door when the hinge pin 235 is positioned at the front corner of the door 220. As illustrated therein, a door 220 also opens and closes a refrigerator compartment 210*a* by being rotated at the axis of a hinge pin 235.

In the case that the hinge pin 235 is positioned as illustrated in FIG. 8, when the door 220 is rotated, a corner part of the door 220 does not protrude over the cabinet 210 as compared with the case of FIG. 7.

However, as the hinge pin 235 is positioned at the front corner of the door 220, the rotational radius of the door 220 is lengthened, thereby creating an interference part "$I_2$" between a door shelf 240 provided on the inside of the door 220 and an inside wall of the cabinet 210. Thus, in order to remove the interference part "$I_2$", the size of the door shelf 240 is required to be decreased, thereby lowering the capacity of the door shelf 240.

SUMMARY OF THE INVENTION

Accordingly, it is an object of the present invention to provide a refrigerator that avoids the necessity of lowering the capacity of a door shelf and that avoids an interference part usually present while the door is rotated.

Additional objects and advantages of the invention will be set forth in part in the description which follows and, in part, will be obvious from the description, or may be learned by practice of the invention.

The foregoing and other objects of the present invention may be accomplished by providing a refrigerator comprising: a cabinet forming a refrigerator compartment; a door opening and closing the refrigerator compartment; and a hinge member rotatably connecting the door to the cabinet, and having a rotation axis varying in position depending on rotation angles of the door between a full open position at which the refrigerator compartment is fully opened and a closed position at which the refrigerator compartment is closed.

Preferably, the hinge member comprises: a hinge bracket having a first end provided with a plurality of elongated holes and connected to the door; a second end connected to the cabinet; and a plurality of hinge pins connected to the door through the plurality of elongated holes of the hinge bracket, respectively.

In one aspect of the invention, the hinge member further comprises a bracket cover covering the hinge member.

Further, the plurality of hinge pins include three pins, and the plurality of elongated holes comprises: a first elongated hole guiding a first hinge pin therein when the door is rotated from the closed position to the fully open position; a second elongated hole having an arc shape, spaced from the first elongated hole, and guiding the second hinge pin therein on the axis of the moved first hinge pin; and a third elongated hole having a radius of curvature larger than that of the second elongated hole, positioned outside the second elongated hole, and guiding a third hinge pin therein.

Further, the radius of curvature of the third elongated hole partially varies depending on the rotation angles of the door.

In another aspect of the invention, the rotation axis of the door moves from the second pin to the first pin according to the rotation angle of the door as it increases from the closed position to the full open position.

In yet another aspect of the invention, the first elongated hole is positioned at a corner of the hinge bracket connected to the door in a radial direction of the second and third elongated holes.

BRIEF DESCRIPTION OF THE DRAWINGS

These and other objects and advantages of the invention will become apparent and more readily appreciated from the following description of the embodiments, taken in conjunction with the accompanying drawings of which.

DETAILED DESCRIPTION OF THE PREFERRED EMBODIMENT

Figure 1:
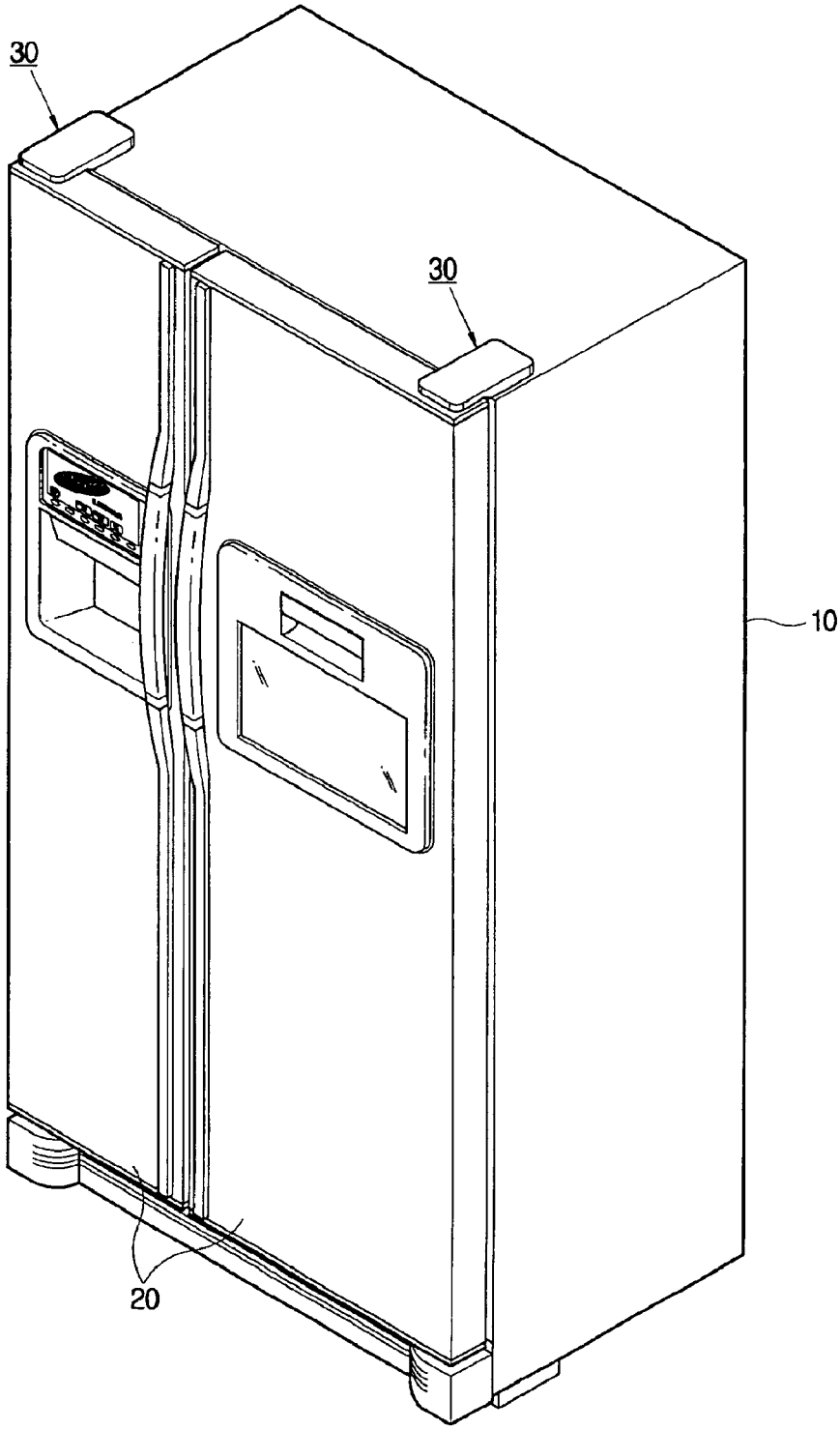
FIG. 1 is a perspective view of a refrigerator according to an embodiment the present invention.

Reference will now be made in detail to the embodiments of the present invention, examples of which are illustrated in the accompanying drawings, wherein like reference numerals refer to like elements throughout. The embodiments are described below in order to explain the present invention by referring to the figures.

Figure 3:
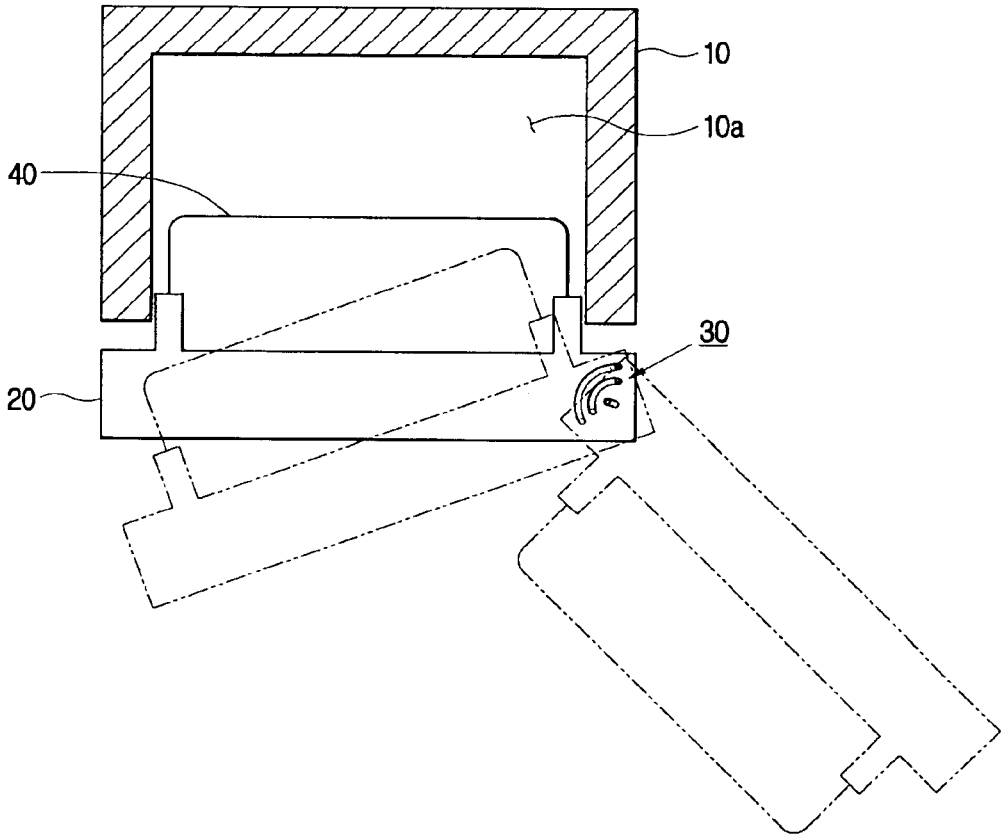
FIG. 3 is a partial sectional view of the refrigerator of FIG. 1 schematically illustrating rotation of a door thereof.

As illustrated in FIG. 1, a refrigerator according to an embodiment of the present invention comprises a cabinet 10 forming a refrigerator compartment 10*a*, and a door 20 provided in front of the refrigerator compartment 10*a* (see FIG. 3) to open and close the refrigerator compartment 10*a*.

The cabinet 10 and the door 20 are connected by hinge members 30 provided at the top and bottom of the cabinet 10. The hinge member 30 operates as a rotation axis of the door 20. Herein, the rotation axis moves in correspondence to rotation angles of the door 20 rotating between a full open position at which the refrigerator compartment 10*a* is fully opened and a closed position at which the refrigerator compartment 10*a* is closed.

Figure 2:
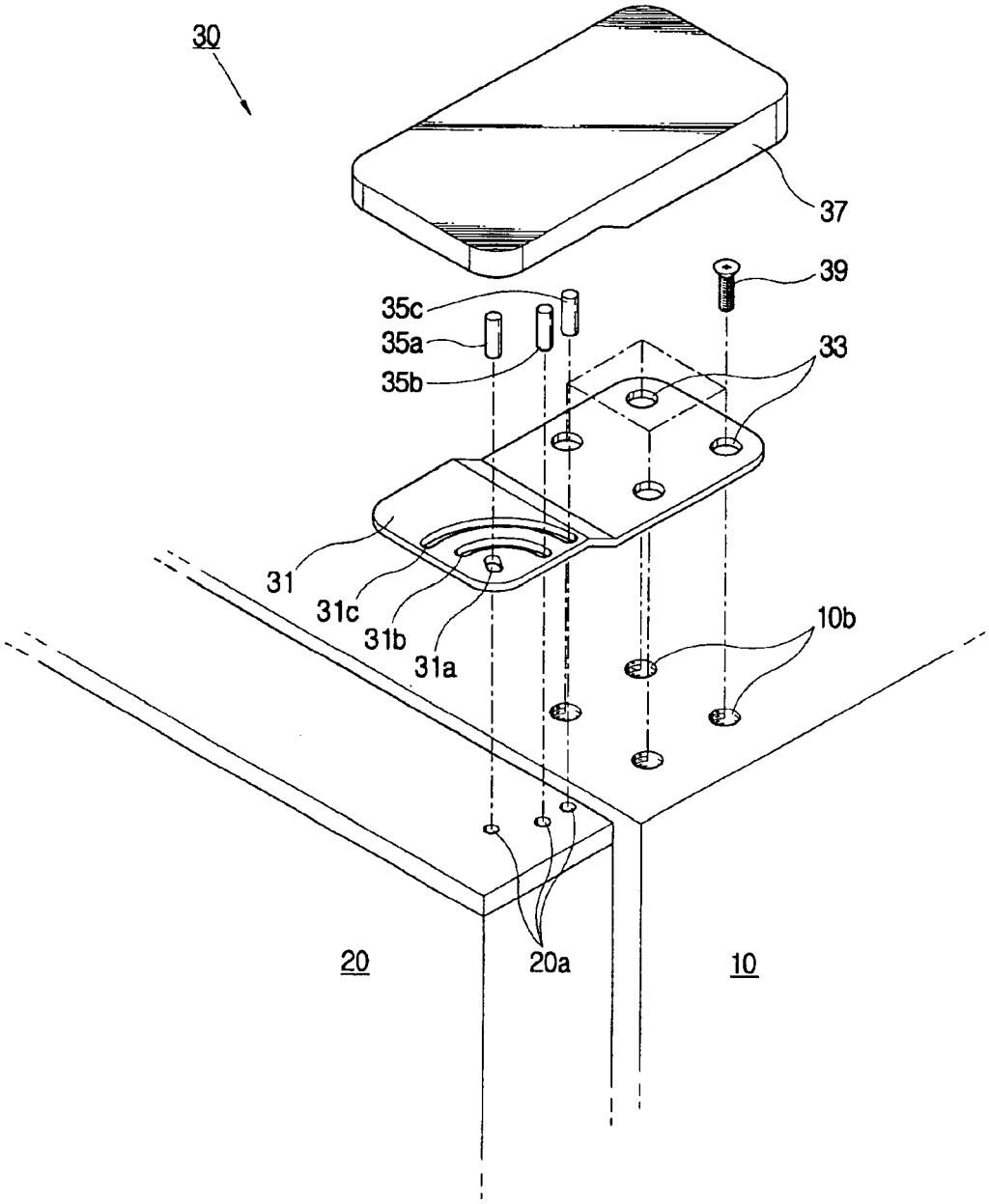
FIG. 2 is an exploded perspective view of a hinge part of the refrigerator of FIG. 1.

As illustrated in FIG. 2, the hinge member 30 includes a hinge bracket 31 having first and second ends each connected to the door 20 and the cabinet 10, respectively, a plurality of hinge pins 35*a*~35*c* to connect the hinge bracket 31 to the door 20, and a bracket cover 37 covering the hinge bracket 31 and the hinge pins 35*a*~35*c*.

On the first end of the hinge bracket 31 to be connected to the door 20 is provided a plurality of elongated holes 31*a*~31*c*, and on the second end of the hinge bracket 31 to be connected to the cabinet 10 is provided a plurality of through holes 33. On the cabinet 10 is provided a plurality of screw holes 10*b* in correspondence with the through holes 33 of the hinge bracket 31. Thus, the second end of the hinge bracket 31 is connected to the cabinet 10 by screw-coupling bolts 39 screwed into the screw holes 10*b* of the cabinet 10 through the through holes 33 of the hinge bracket 31.

On the door 20 is provided a plurality of through holes 20*a* in correspondence with the elongated holes 31*a*~31*c* of the hinge bracket 31. Thus, the hinge pins 35*a*~35*c* are inserted into the through holes 20*a* of the door 20 through the elongated holes 31*a*~31*c* of the hinge bracket 31 to thereby enable the door 20 to rotate while centering around at least one of the hinge pins 35*a*~35*c*.

It is an aspect of the invention that three elongated holes 31*a*~31*c* are provided on the first end of the hinge bracket 31 and three hinge pins 35*a*~35*c* are each inserted in the three elongated holes 31*a*~31*c*, respectively. Hereinbelow, the first, second and third elongated holes 31*a*~31*c* and the first, second and third hinge pins 35*a*~35*c* will be described in more detail.

The first elongated hole 31*a* is relatively short and diagonally elongated at one corner of the hinge bracket 31. The second elongated hole 31*b* is spaced from the first elongated hole 31*a*, forming an arc. The third elongated hole 31*c* is spaced from the second elongated hole 31*b* at the outside thereof, forming an arc having a radius of curvature larger than that of the second elongated hole 31*b*.

The first hinge pin 35*a* is accommodated in the first elongated hole 31*a* and diagonally moves in the first elongated hole 31 a when the door 20 is rotated between the closed position and the full open position. The second hinge pin 35*b* is accommodated in the second elongated hole 31*b* and moves within the second elongated hole 31*b* when the door is rotated on the axis of the first hinge pin 35*a*. The third hinge pin 35*c* is accommodated in the third elongated hole 31*c* and guided by the third elongated hole 31*c* according to the movement of the first and second hinge pins 35*a* and 35*c*.

With the above configuration, the rotation of the door 20 will be described hereinbelow while referring to FIG. 3 through 6.

Figure 4:
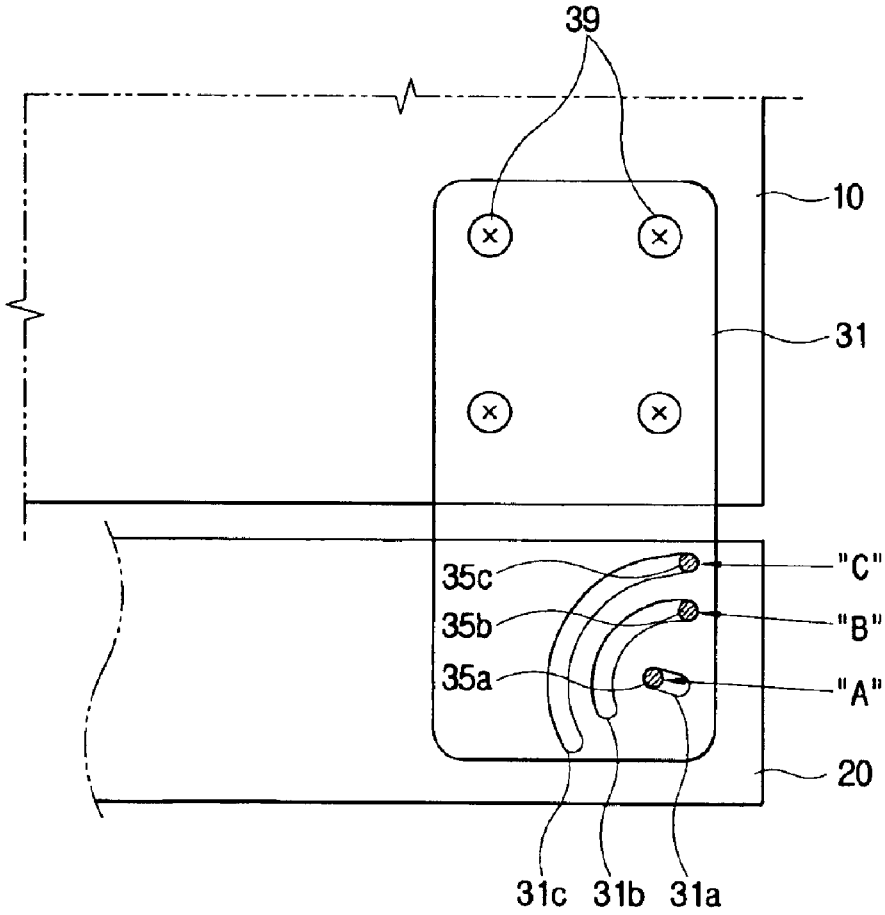
FIGS. 4 through 6 illustrate operations of the hinge member according to rotation angles of the door in the refrigerator of FIG. 1.

In the closed position at which the door 20 closes the refrigerator compartment 10*a*, the first, second and third hinge pins 35*a*, 35*b* and 35*c* are, as illustrated in FIG. 4, positioned at "A" of the first elongated hole 31*a*, "B" of the second elongated hole 31*b*, and "C" of the third elongated hole 31*c*, respectively.

Figure 5:
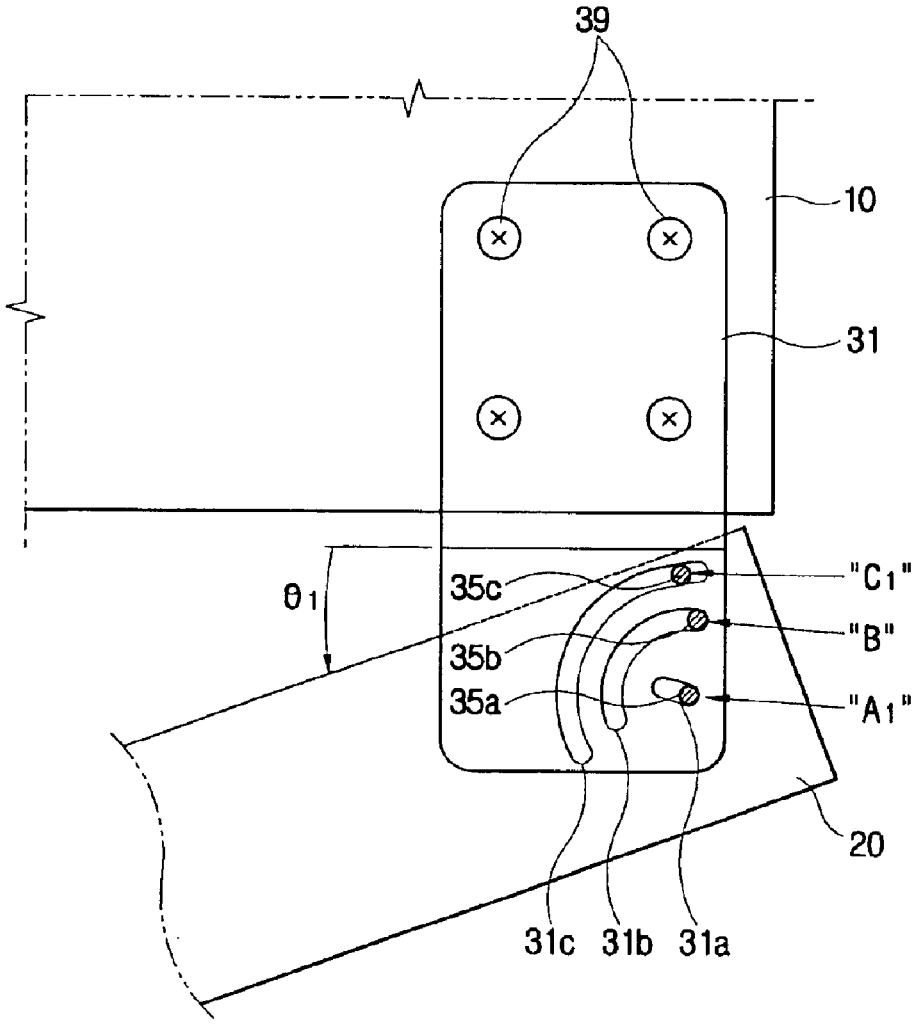

When the door 20 is rotated at an angle of $\theta_1$ (e.g., approximately 20°), the first and third hinge pins 35*a* and 35*c*, as illustrated in FIG. 5, move from "A" to "$A_1$" in the first elongated hole 31*a*, and from "C" to "$C_1$" in the third elongated hole 31*c*, respectively. However, the second hinge pin 35*b* is still at "B". That is, when the door 20 is rotated at an angle of $\theta_1$ (e.g., approximately 20°), the first and third hinge pins 35*a* and 35*c* move on the axis of the second hinge pin 35*b* within the first and third elongated holes 31*a* and 31*c*, respectively. Herein, in the third elongated hole 31*c* corresponding with the third hinge pin 35*c*, an arc from "C" to "$C_1$" and an arc from "$C_1$" to "$C_2$" (FIG. 6) are different in a radius of curvature.

Figure 6:
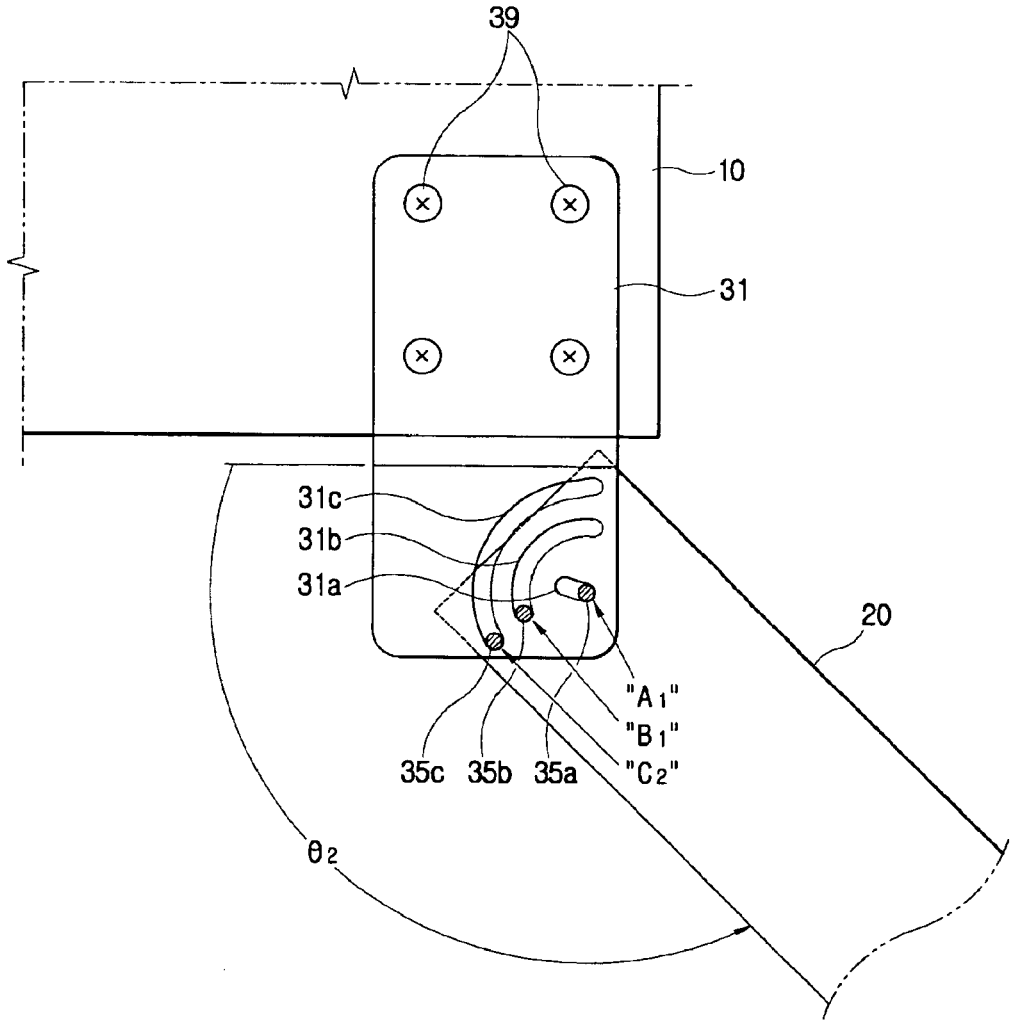
Figure 7:
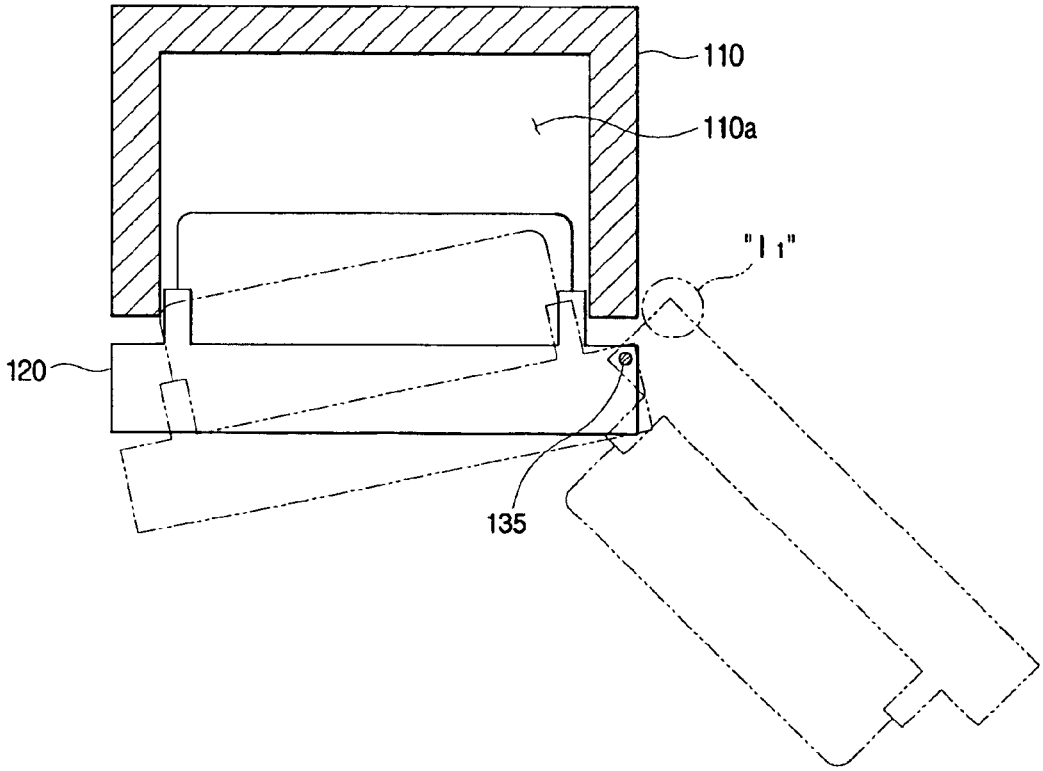
FIG. 7 (PRIOR ART)
FIGS. 7 and 8 are schematic sectional views of a conventional refrigerator for illustrating the rotations of a door according to positions of a hinge pin, respectively.
Figure 8:
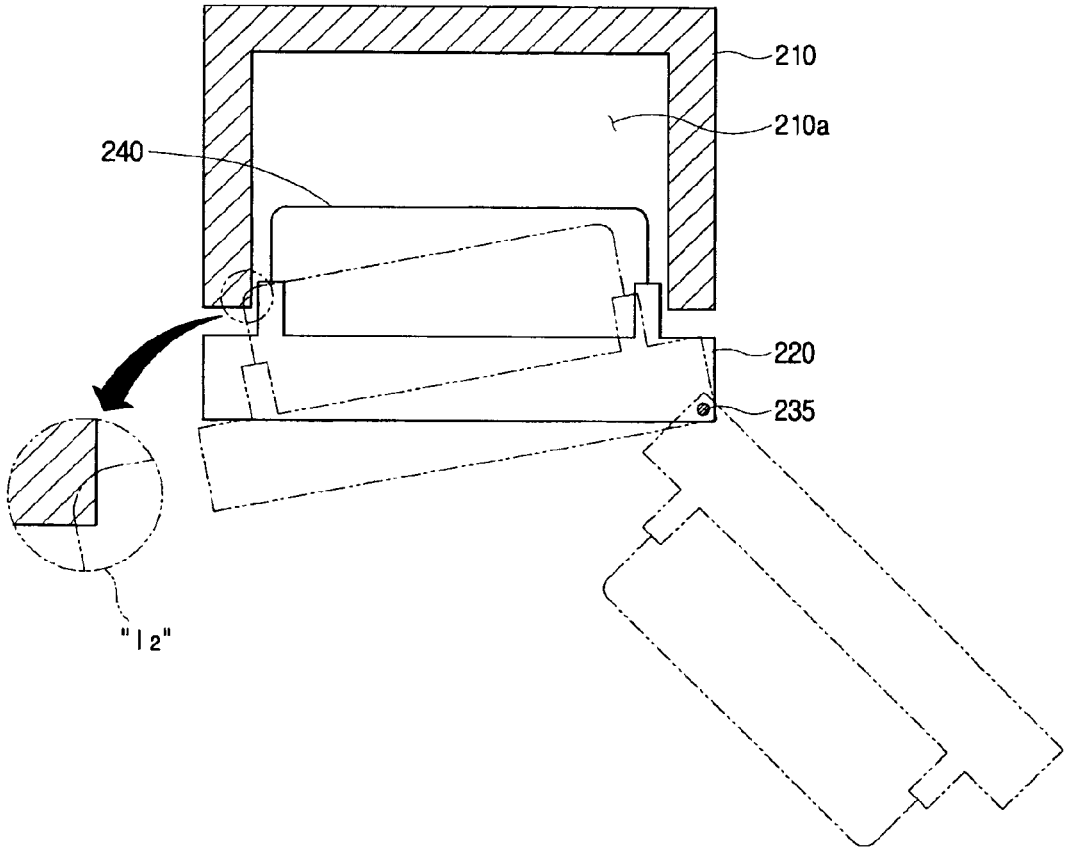
FIG. 8 (PRIOR ART)

When the door 20 is further rotated at an angle of $\theta_2$ (e.g., approximately 135°) from the state of FIG. 5 to the full open position, the second and third hinge pins 35*b* and 35*c*, as illustrated in FIG. 6, move from "B" to "$B_1$" in the second elongated hole 31*b*, and from "$C_1$" to "$C_2$" in the third elongated hole 31*c* on the axis of the first hinge pin 35*a* positioned at "$A_1$", respectively.

As described above, in the hinge member 30 according to an embodiment of the present invention, the rotation axis of the door 20 moves between the second hinge pin 35*b* and the first hinge pin 35*a* so as to shorten the radius of the rotation of the door 20. Therefore, there is no need to decrease the capacity of a door shelf 40. Moreover, even if the door 20 is completely opened, a corner part of the door 20 is prevented from protruding over the cabinet 10, thereby removing the interference part.

On the other hand, the rotation of the door 20 from the full open position to the close position is performed in the reverse order to the above-described rotation.

In the above description, the hinge part 30 provided at the top of the right door 20 in FIG. 1 has been described in more detail. It will be fully appreciated that a hinge member provided at the bottom of the right door or hinge members provided at the left door may have a similar configuration.

As described above, the present invention provides a refrigerator avoiding the necessity of lowering the capacity of a door shelf so as to open a door and avoiding an interference part present while the door is rotated.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A refrigerator comprising:

a cabinet forming a refrigerator compartment;

a door opening and closing the refrigerator compartment; and a hinge member including a hinge bracket having a first end provided with a plurality of elongated holes and connected to the door, and a second end connected to the cabinet, and a plurality of hinge pins connected to the door through the plurality of elongated holes of the hinge bracket, respectively, the hinge member rotatably connecting the door to the cabinet, and having a rotation axis varying in position depending on rotation angles of the door between a full open position at which the refrigerator compartment is fully opened and a closed position at which the refrigerator compartment is closed, wherein the plurality of hinge pins comprises first, second, and third hinge pins, and the plurality of elongated holes comprise a first elongated hole guiding the first hinge pin therein when the door is rotated from the closed position to the fully open position; a second elongated hole having an arc shape, spaced from the first elongated hole, and guiding the second hinge pin therein on the axis of the first hinge pin; and a third elongated hole having a radius of curvature larger than that of the second elongated hole, positioned outside the second elongated hole, and guiding the third hinge pin therein.

2. The refrigerator according to claim 1, wherein the radius of curvature of the third elongated hole partially varies depending on the rotation angles of the door.

3. The refrigerator according to claim 2, wherein the rotation axis of the door moves from the second pin to the first pin according to the rotation angle of the door as the door rotation increases from the closed position to the full open position.

4. The refrigerator according to claim 3, wherein the first elongated hole is positioned at a corner of the hinge bracket connected to the door in a radial direction of the second and third elongated hole.

5. The refrigerator according to claim 2, wherein the first elongated hole is positioned at a corner of the hinge bracket connected to the door in a radial direction of the second and third elongated holes.

6. The refrigerator according to claim 1, wherein the first elongated hole is positioned at a corner of the hinge bracket connected to the door in a radial direction of the second and third elongated holes.

7. A refrigerator comprising:

a compartment;

a door to open and close said compartment; and a hinge member rotatably connecting said door to said compartment, said hinge member having a rotation axis varying in position depending on the degree of rotation of said door with respect to said compartment, wherein said hinge member comprises first, second and third elongated holes to connect said door to said compartment, said axis of rotation is positioned at said second elongated hole during a predetermined degree of rotation of said door and at said first elongated hole during the remaining degrees of rotation of said door to the fully opened position, said first elongated hole is positioned at a corner of said hinge member, said second elongated hole is formed of an arc at a radial distance from said first elongated hole, and said third elongated hole is formed of an arc at a radial distance from said second elongated hole, and said hinge member further comprises first, second and third hinge pins, said first hinge pin, said second hinge pin and said third hinge pin being in contact with a first end of said first elongated hole, a first end of said second elongated hole and a first end of said third elongated hole, respectively, when the door is closed, said first hinge pin being in contact with a second end of said first elongated hole when the door is opened to a position between said predetermined degree and said remaining degree, and said second hinge pin and said third hinge pin being in contact with a second end of said second elongated hole and a second end of said third elongated hole when the door is in the fully opened position.

* * * * *